US008390404B2

(12) United States Patent
Zou

(10) Patent No.: US 8,390,404 B2
(45) Date of Patent: Mar. 5, 2013

(54) POWER PLUG WITH CABLE LEAKAGE PROTECTIVE FUNCTION

(75) Inventor: Bill Zou, Zhongshan (CN)

(73) Assignee: Zhongshan Kaper Electrical Co., Ltd. (CN)

( * ) Notice: Subject to any disclaimer, the term of this patent is extended or adjusted under 35 U.S.C. 154(b) by 0 days.

(21) Appl. No.: 13/319,854

(22) PCT Filed: Jan. 13, 2010

(86) PCT No.: PCT/CN2010/000059

§ 371 (c)(1),
(2), (4) Date: Nov. 10, 2011

(87) PCT Pub. No.: WO2010/135903

PCT Pub. Date: Dec. 2, 2010

(65) Prior Publication Data

US 2012/0052702 A1 Mar. 1, 2012

(30) Foreign Application Priority Data

May 27, 2009 (CN) ..... 2009 2 0057724 U

(51) Int. Cl.
*H01H 3/14* (2006.01)
*H01H 83/02* (2006.01)

(52) U.S. Cl. ..... 335/6; 335/18; 335/21; 361/42

(58) Field of Classification Search ..... 335/6, 18, 335/21; 361/42
See application file for complete search history.

(56) References Cited

U.S. PATENT DOCUMENTS 5,661,623 A * 8/1997 McDonald et al. ..... 361/42
5,862,029 A * 1/1999 Nicol ..... 361/42
6,122,155 A * 9/2000 Aromin et al. ..... 361/42
6,624,991 B2 * 9/2003 Chu ..... 361/42
7,170,375 B2 * 1/2007 Chen et al. ..... 335/177
7,623,329 B2 * 11/2009 Williams et al. ..... 361/42
7,672,098 B2 * 3/2010 Zhang et al. ..... 361/42
(Continued)

FOREIGN PATENT DOCUMENTS

CN 200965956 Y 10/2007
CN 201185273 Y 1/2009
(Continued)

OTHER PUBLICATIONS

International Search Report, PCT/CN2010/000059, dated Apr. 22, 2010.

*Primary Examiner* — Ramon Barrera
(74) *Attorney, Agent, or Firm* — Lerner, David, Littenberg, Krumholz & Mentlik, LLP

(57) ABSTRACT

The present invention discloses a power plug providing leakage protection comprising a casing, reset button and test button provided to the surface of the top of the casing; wherein movable springs respectively connected to power supply live wire and neutral wire pins are fixedly provided to the bottom part of a circuit board, movable contact points have separate electrical connections with free ends of the movable springs, stationary contact points corresponding to the movable contact points are provided to the circuit board and connected to a loading power supply cable; and a tripping device capable of contacting or disconnecting the movable and stationary contact points is provided inside the casing. The present invention is safe; has strong protective performance, simple structure, and reasonable design, and is safe, suited for mass production, and able to detect a power cable leakage failure and promptly sever the loaded connection with the power supply.

9 Claims, 12 Drawing Sheets

U.S. PATENT DOCUMENTS

| | | | | |
|---|---|---|---|---|
| 2006/0061924 | A1* | 3/2006 | Zhang | 361/42 |
| 2006/0146456 | A1* | 7/2006 | Williams | 361/42 |
| 2009/0251832 | A1* | 10/2009 | Brugner et al. | 361/42 |
| 2010/0020452 | A1* | 1/2010 | Gandolfi | 361/42 |

FOREIGN PATENT DOCUMENTS

| | | | |
|---|---|---|---|
| CN | 201425995 | Y | 3/2010 |
| WO | 2010/135903 | A1 | 12/2010 |

* cited by examiner

A-A

POWER PLUG WITH CABLE LEAKAGE PROTECTIVE FUNCTION

CROSS-REFERENCE TO RELATED APPLICATIONS

The present application is a national phase entry under 35 U.S.C. §371 of International Application No. PCT/CN2010/000059, filed Jan. 13, 2010, published in Chinese, which claims priority from CN 200920057724.4, filed May 27, 2009, all of which are incorporated herein by reference.

BACKGROUND OF THE INVENTION

The present invention relates to a power plug having a leakage protection function, i.e., ground fault circuit interrupter (abbreviated as GFCI), and refers in particular to a power plug having a leakage protection function that is installed onto a household appliance such as an air conditioner, a refrigerator, or a television.

At present, people connect household appliances to the utility power supply via power plugs; the majority of power plugs that are currently commercially available are structured so as to comprise a casing, two or three externally exposed pins and a power cable wire connected to the pins being installed onto the casing, such that a direct and fixed connection is made between the power cable wire of the power plug and a power contact on a circuit board inside the appliance, thus forming an electrical connection. When there is a need to use a household appliance, the pins of the power plug need only be inserted into the socket to achieve a connection between the household appliance and the utility power supply. Because the interior of such power plugs does not possess a leakage protection structure, pulling the pins out creates a leakage failure with a live wire, neutral wire, and ground wire; the live, neutral, and ground wires encounter a leaking fault, and a short-circuiting failure occurs between the live and neutral wires on the output terminal of the power plug, and the household appliance suffers direct damage. There have already appeared a number of power plugs having leakage protection functions; despite the ability thereof to cut off the power supply when a failure occurs in order to act to protect the household appliance, these power plugs have at present a relatively more complicated internal structure, which is not suited for mass production, and thus there is a need to solve the above problems.

BRIEF SUMMARY OF THE INVENTION

To overcome the above-described technical deficiencies, the present invention provides a power plug having a leakage protection function, which is safe and has strong protective performance, has a simple structure and reasonable design, is suited for mass production, and is able during use to detect a power cable leakage failure and to promptly sever the loaded connection with the power supply.

The power plug having a leakage protection function comprises a casing, a reset button and a test button being provided to the surface of the top of the casing; a power supply live wire pin, neutral wire pin, and ground wire pin being provided to the bottom of the casing; a circuit board being provided to the interior of the casing; and a leakage protection circuit for detecting a cable leakage failure on the output of the power source being provided onto the circuit board; wherein a pair of movable springs for separate electrical connections with the power supply live wire plug and the neutral wire plug are fixedly provided to the bottom of the circuit board, movable contact points of the separate electrical connections being on the free ends of the pair of movable springs, and a pair of stationary contact points corresponding to the movable contact points being provided on the circuit board, such that the stationary contact points are connected with the power supply cable for the connection load; and wherein a tripping device capable of contacting or disconnecting the movable contact points and stationary points is provided inside the casing, the tripping device comprising a rod that is fixedly connected to the reset button, such that a rod reset spring that is disposed on the rod is fixed to a trip board on the free ends of the pair of movable springs and is provided to the stationary armature and movable armature inside the trip coil, the lower end of the rod being slidably connected to the movable armature and a locking bit being provided on the rod, and the trip board being provided with a bayonet of the locking bit, which can lock the rod in after the stationary armature has attracted the movable armature.

The casing is constituted of a front-top cover, a rear-top cover, and a lower cover for fastening the front-top cover and rear-top cover together, the reset button and test button being provided in holes on the top surface of the rear-top cover and exposed to the exterior; the power supply live wire pin, neutral wire pin, and ground wire pin perforate holes in the lower surface of the lower cover and extend outwardly.

One end of the movable armature stretches out of the trip coil, that end being provided with an annular groove; the lower end of the rod is provided with a longitudinal slot that slidably interlocks with the annular groove.

A protective shield is fixedly provided to the bottom of the circuit board, the trip coil being fixed into the protective shield, and an opening through which the movable armature perforates being arranged on the protective shield; a pair of fixed ears are disposed on the top of the protective shield, one end of each of the pair of movable springs being fixed to the pair of fixed ears, and a pin fixation board is fixedly provided to the bottom of the protective shield, jacks for fixing the pins being provided on the pin fixation board.

The trip board is provided with two connection blocks, fixation holes being arranged on the connection blocks; the free ends of the movable springs are inserted into and locked into the fixation holes and cause the trip board to be fixed to the end parts of the two movable springs, the movable contact points being provided on the connection blocks and electrically connected to the movable springs.

The bottom surface of the test button is provided with a U-shaped metal pin and test reset spring; the bottom of the circuit board corresponding to the U-shaped metal pin is provided with two test solder joints, which together with the U-shaped metal pin constitute a simulation test switch.

The leakage protection circuit comprises a trip coil, two zero-sequence transformers, a control chip, and a silicon controlled rectifier; a metal ring of the zero-sequence transformer is disposed on the power supply cable of the connection load, such that a secondary coil of the zero-sequence transformer is connected to the input end of the control chip, the input end of the control chip is connected with the control gate of the silicon controlled rectifier, and the cathode of the silicon controlled rectifier is connected with one end of the trip coil.

The advantageous effects of the present invention are (1) when there is an inadvertent leakage failure while the household appliance is in use, when the leakage current reaches 4~6 mA, then the power supply can be cut off, thus acting to protect the household appliance; (2) when any one phase of the power supply live wire or neutral wire experiences circuit break, the power supply can be cut off, thus acting to protect the household appliance; and (3) the present invention has a relatively simple interior structure and a reasonable design, and is easily mass-produced.

DETAILED DESCRIPTION OF THE INVENTION

Figure 1:
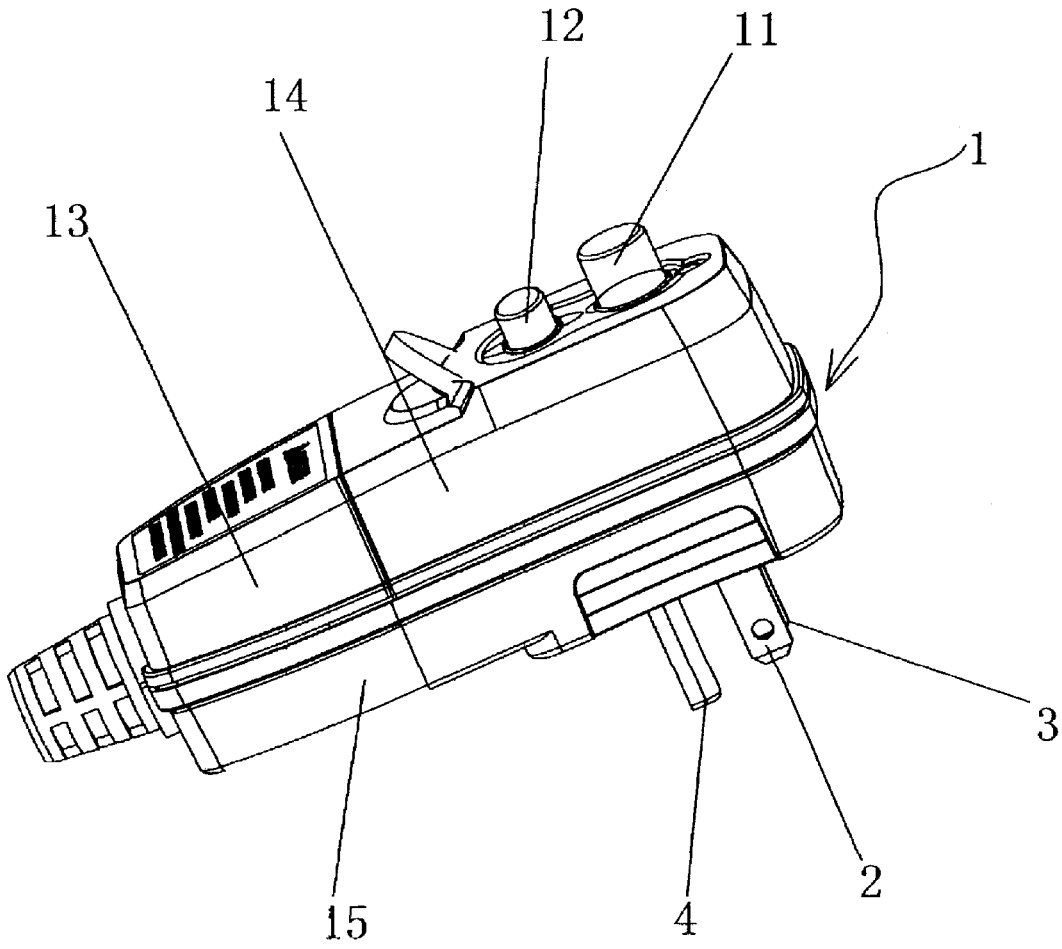
FIG. 1 is a three-dimensional drawing of the present invention.
Figure 2:
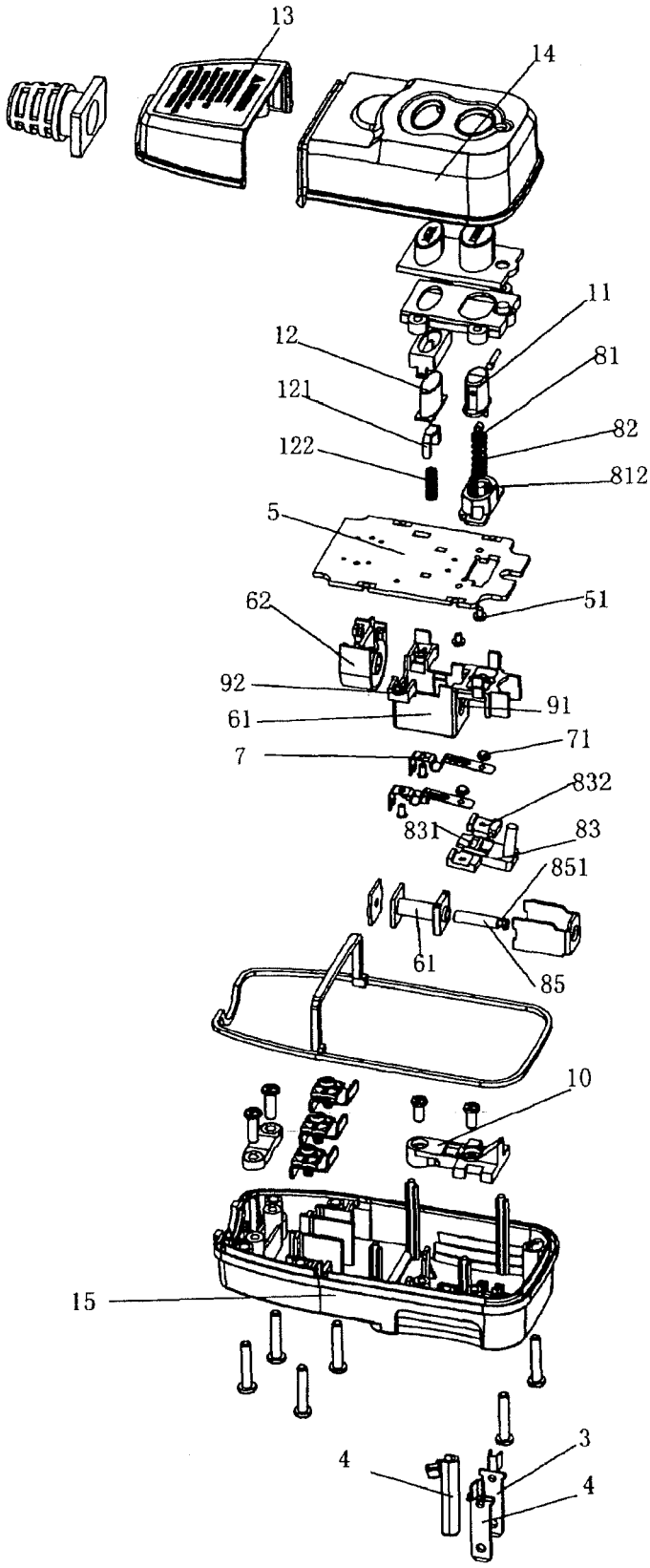
FIG. 2 is a complete exploded view of the present invention.
Figure 3:
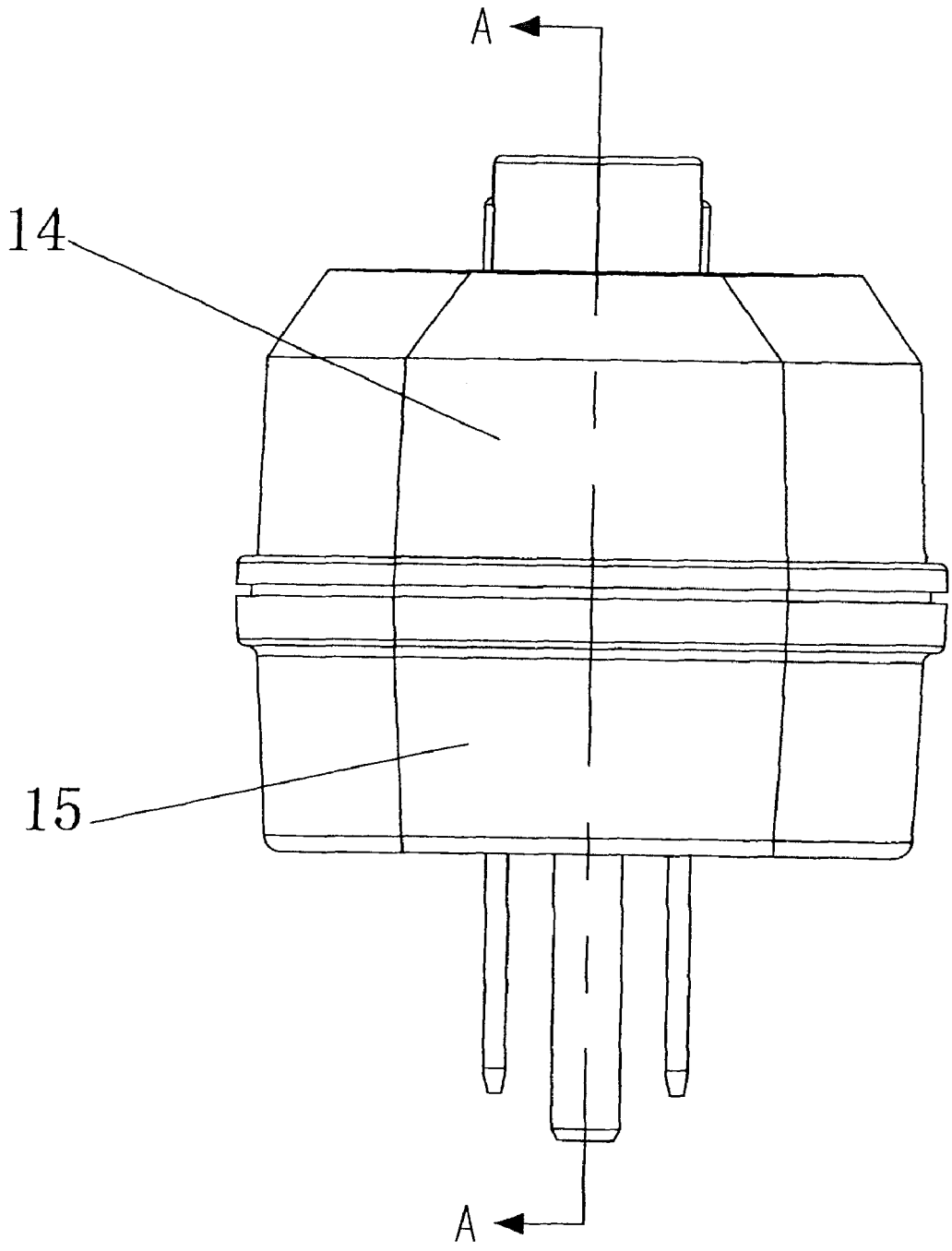
FIG. 3 is a plan view of the present invention.
Figure 4:
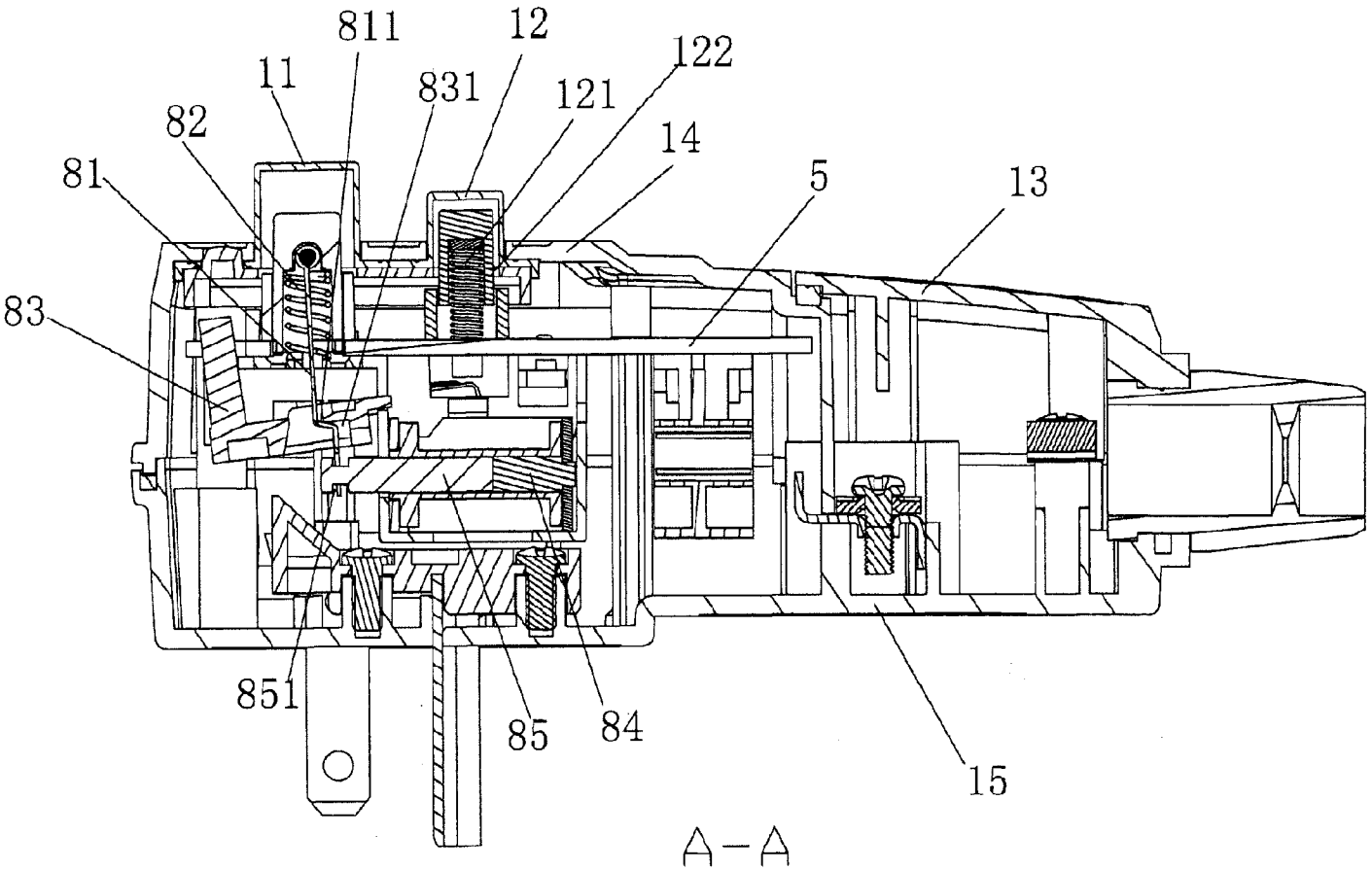
FIG. 4 is a cut-away view in the A-A direction of FIG. 3.
Figure 5:
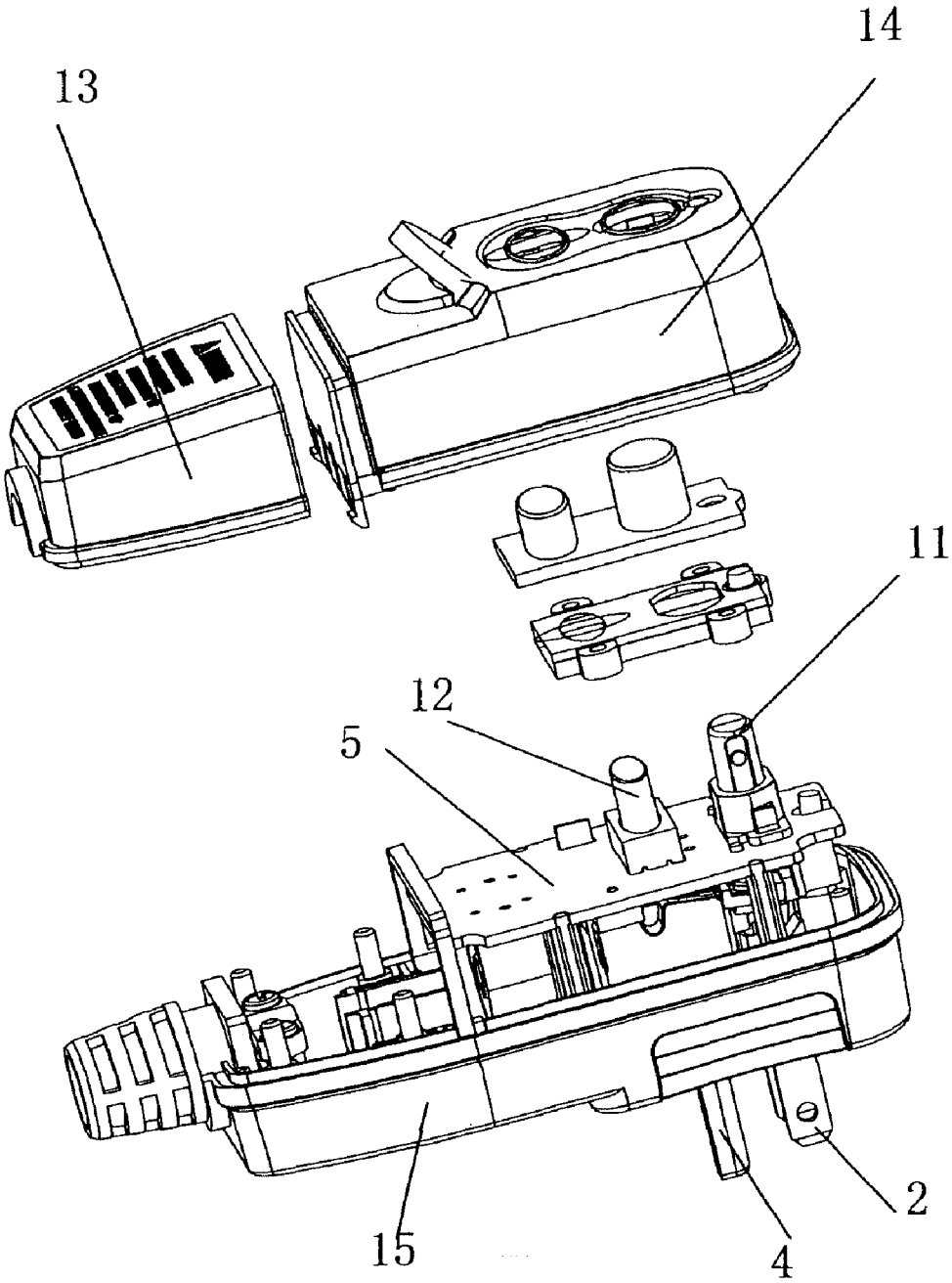
FIG. 5 is a three-dimensional exploded view of the present invention.
Figure 6:
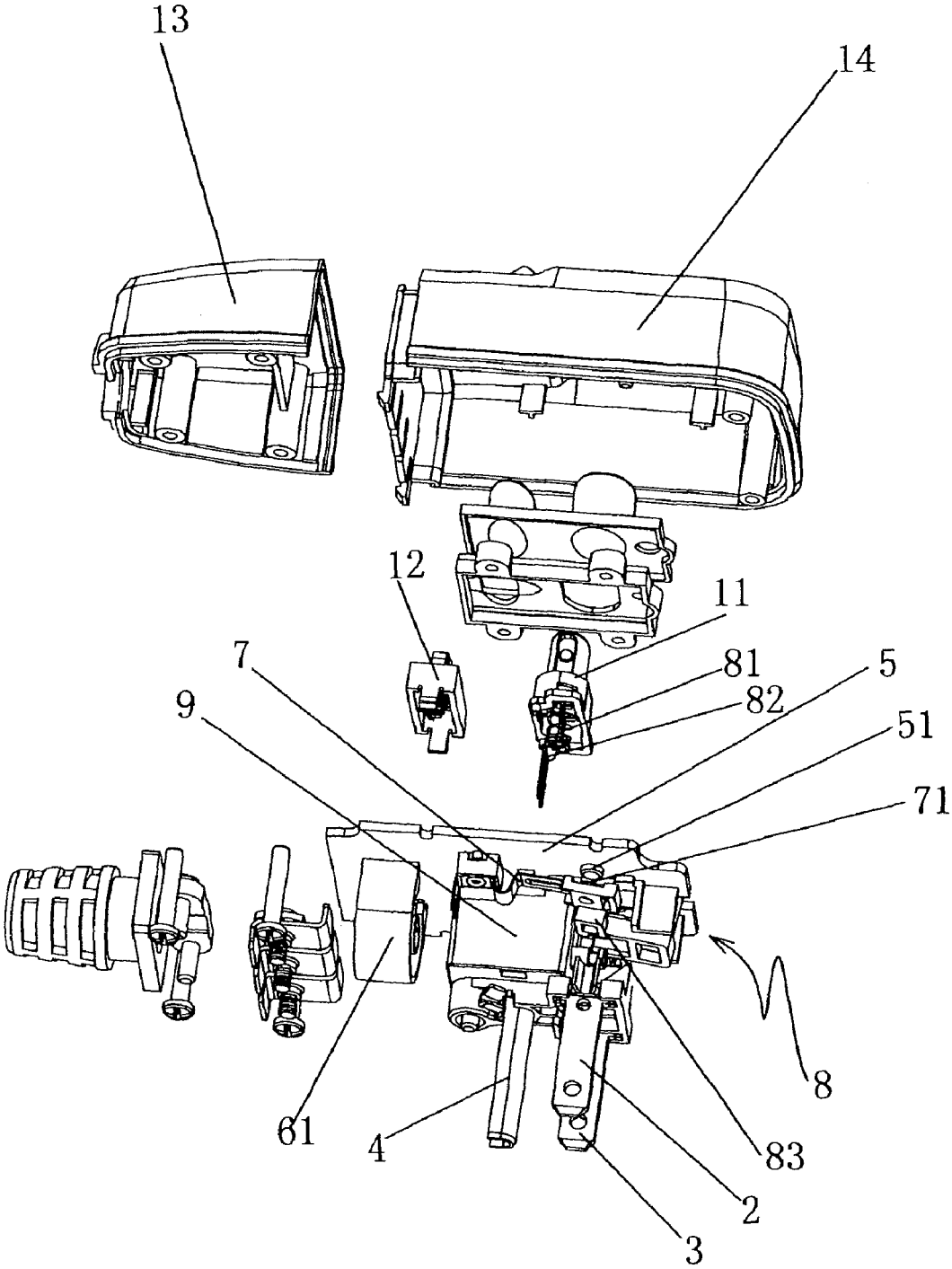
FIG. 6 is a three-dimensional exploded view of FIG. 5 after the lower cover is removed.
Figure 7:
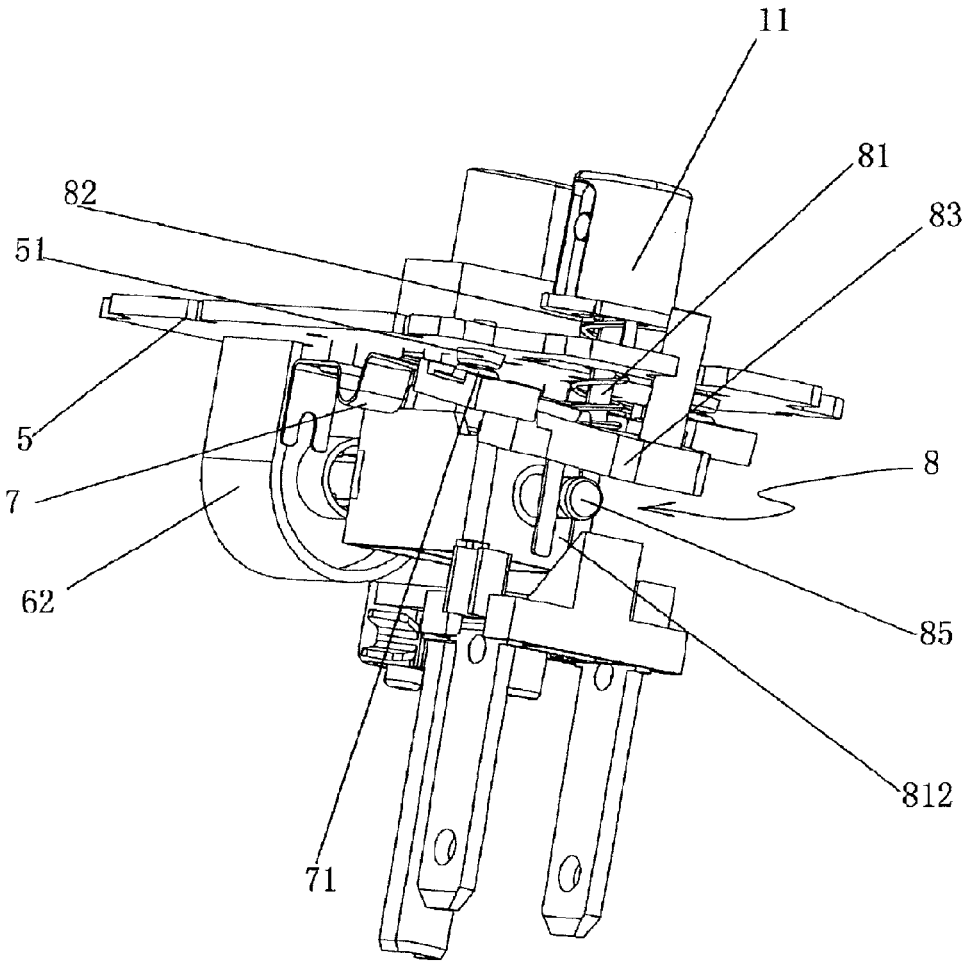
FIG. 7 is a three-dimensional drawing of the tripping device of the present invention.
Figure 8:
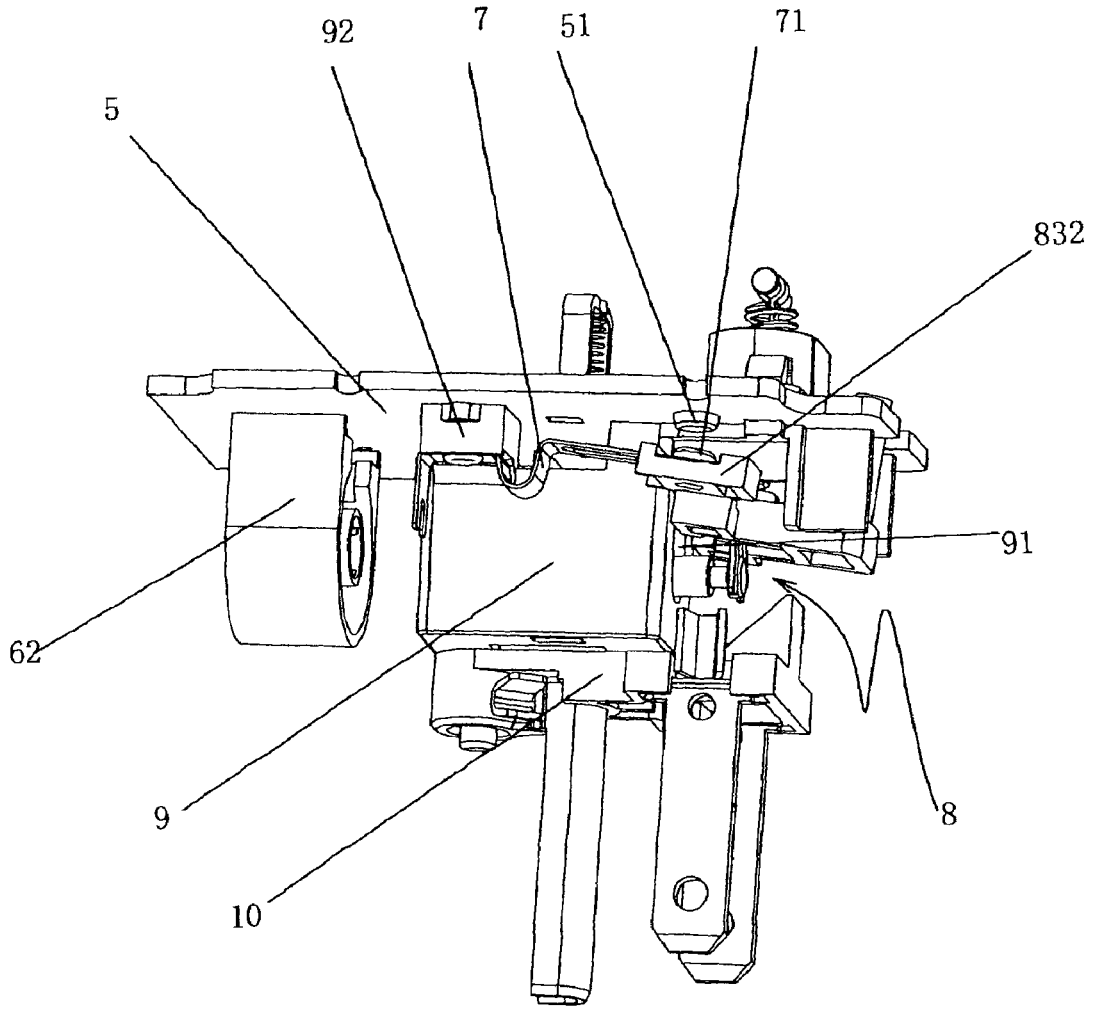
FIG. 8 is a three-dimensional drawing of FIG. 7 after the reset button and test button are removed.
Figure 9:
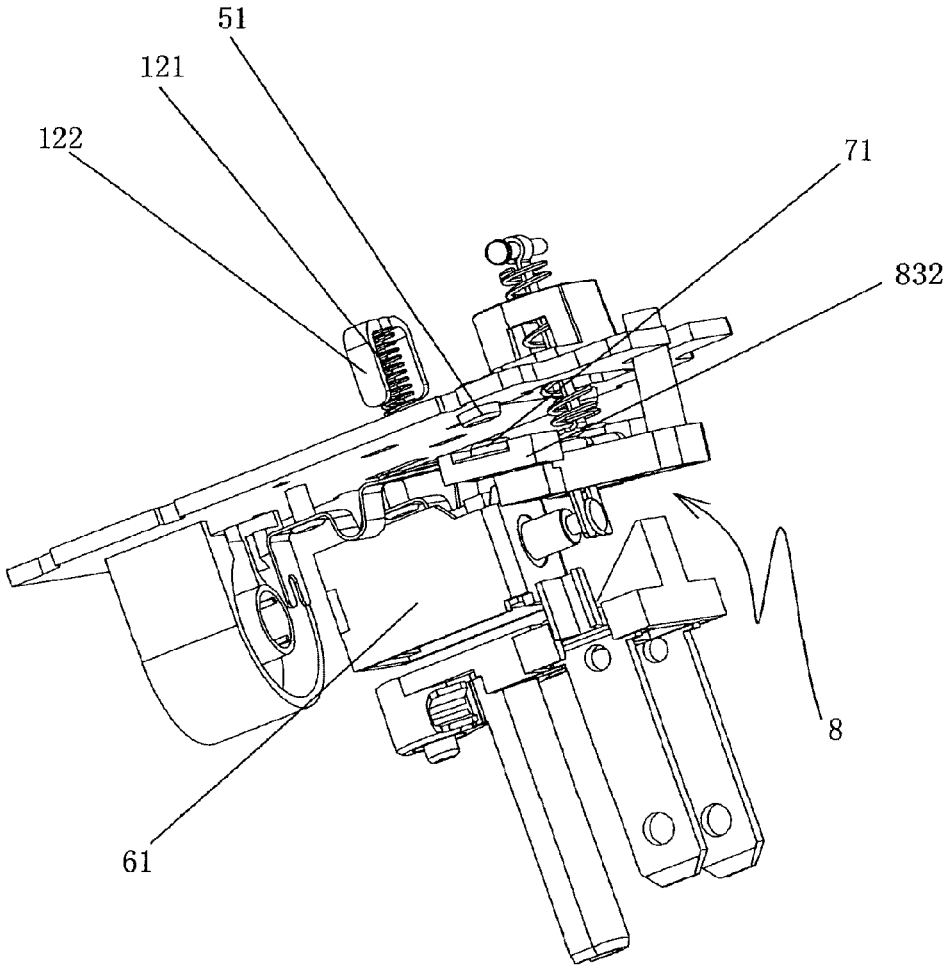
FIG. 9 is a three-dimensional drawing of FIG. 8 after the covers are removed.
Figure 10:
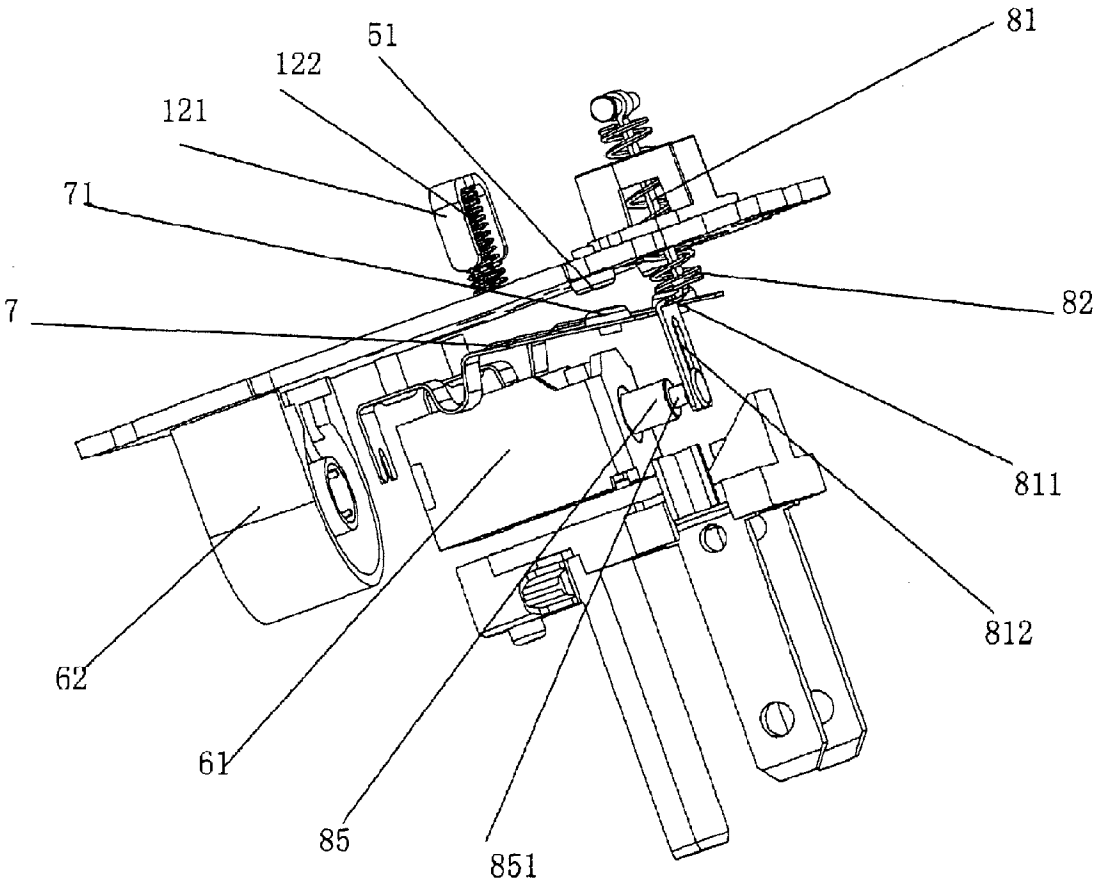
FIG. 10 is a three-dimensional drawing of FIG. 9 after the trip board is removed.
Figure 11:
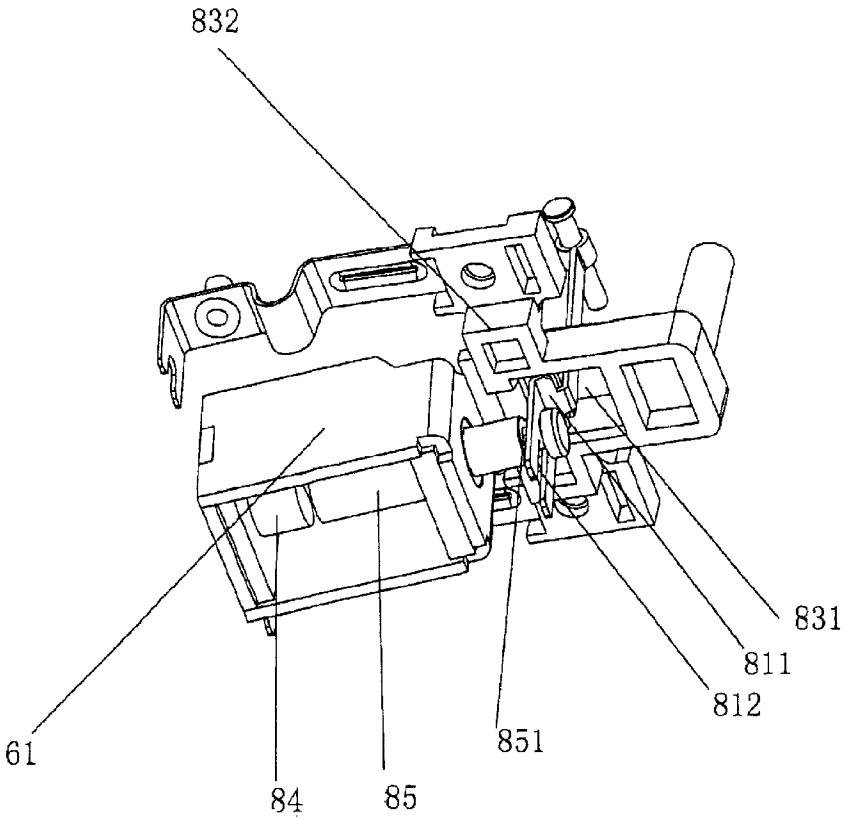
FIG. 11 is a coordinated view between the movable armature and stationary armature of the present invention.

The following combines the drawings with an embodiment of the present invention to provide a more detailed description.

With reference to FIGS. 1 to 11, the present invention discloses a power plug having a leakage protection function, comprising a casing 1, a reset button 11 and a test button 12 being provided to the surface of the top of the casing 1; a power supply live wire pin 2, neutral wire pin 3, and ground wire pin 4 being provided to the bottom of the casing 1; a circuit board 5 being provided to the interior of the casing 1; and a leakage protection circuit for detecting a cable leakage failure on the output of the power source being provided onto the circuit board 5; wherein a pair of movable springs 7 for separate electrical connections with the power supply live wire plug 2 and the neutral wire plug 3 are fixedly provided to the bottom of the circuit board 5, movable contact points 71 of the separate electrical connections being on the free ends of the pair of movable springs 7, and a pair of stationary contact points 51 corresponding to the movable contact points being provided on the circuit board 5, such that the stationary contact points 51 are connected with the power supply cable for the connection load, and such that contacting or disconnecting the movable contact points 71 with the stationary contact points 51 can cause a connection or disconnection between the pins and the power supply cable; and wherein a tripping device 8 capable of contacting or disconnecting the movable contact points 71 and stationary points 51 is provided inside the casing 1, the tripping device 8 comprising a rod 81 that is fixedly connected to the reset button 11, such that a rod reset spring 82 that is disposed on the rod 81 is fixed to a trip board 83 on the free ends of the pair of movable springs 7 and is provided to the stationary armature 84 and movable armature 85 inside the trip coil 61, the lower end of the rod 81 being slidably connected to the movable armature 85 and a lock bit 811 being provided on the rod 81, and the trip board 83 being provided with a bayonet 831, which can lock the lock bit 811 of the rod 81 in after the stationary armature 84 has attracted the movable armature 85. When the present power plug is used, the pins are first inserted into a sock connected to the utility power supply, and thereafter the reset button 11 is pressed and held down by hand, causing the rod 81 to move downward; when pressed to a given position, the surface on the locking bit 811 on the rod 81 is locked into the bayonet 831 on the trip board 83. When there is a need to use a household appliance, the pin of the power plug must be inserted into the socket, whereupon there is a disconnect between the movable contact points 71 and the stationary contact points 51, such that when there is a desire to create a connection between the household appliance and the utility power supply, the reset button 11 must be pressed, which causes the rod 81 to move downward, and simultaneously also places pressure on the rod reset spring 82. When the locking bit 811 on the rod 81 penetrates the bayonet 831 on the trip board 83, because an electrical current runs through the trip coil 61, the stationary armature 84 therewithin is made to be magnetic, thus attracting the movable armature 85; the movable armature 85 causes the rod 81 to move toward the direction of the stationary armature 84, causing the locking bit 811 to lock onto the bayonet 831, whereupon the hand is released. The rod reset spring 82 resets and causes the rod 81 to move upward, and the rod 81 causes the trip board 83 to move upward, and therefore causes the free ends of the movable springs 7 to swing upward, causing the movable contact points 71 to come into contact with the stationary contact points 51. A connection is thus made between the power supply cable of the connection load and the pins, thereby allowing the utility power supply to pass through the present plug and supply power to the household appliance.

The casing 1 is constituted of a front-top cover 13, a rear-top cover 14, and a lower cover 15 for fastening the front-top cover 13 and rear-top cover 14 together, the reset button 11 and test button 12 being provided in holes on the top surface of the rear-top cover 14 and exposed to the exterior; the power supply live wire pin 2, neutral wire pin 3, and ground wire pin 4 perforate holes in the lower surface of the lower cover 15 and extend outwardly.

One end of the movable armature 85 stretches out of the trip coil 61, that end being provided with an annular groove 851; the lower end of the rod 81 is provided with a longitudinal slot 812 that slidably interlocks with the annular groove 851.

A protective shield 9 is fixedly provided to the bottom of the circuit board 5, the trip coil 61 being fixed into the protective shield 9, and an opening 91 through which the movable armature 85 perforates being arranged on the protective shield 9; a pair of fixed ears 92 are disposed on the top of the protective shield 9, one end of each of the pair of movable springs 7 being fixed to the pair of fixed ears 92, and a pin fixation board 10 is fixedly provided to the bottom of the protective shield 9, jacks for fixing the pins being provided on the pin fixation board 10.

The trip board 83 is provided with two connection blocks 832, fixation holes being arranged on the connection blocks 832; the free ends of the movable springs 7 are inserted into and locked into the fixation holes and cause the trip board 83 to be fixed to the end parts of the two movable springs 7, the movable contact points 71 being provided on the connection blocks 832 and electrically connected to the movable springs 7.

The bottom surface of the test button 12 is provided with a U-shaped metal pin 121 and test reset spring 122; the bottom of the circuit board 5 corresponding to the U-shaped metal pin 12 is provided with two test solder joints, which together with the U-shaped metal pin 121 constitute a simulation test switch TEST. When the test button 12 is pressed down, the U-shaped metal pin 121 instantly comes into contact with the two test solder joints on the circuit board 5, creating conduction in a test circuit, such that the zero-sequence transformers 62 on the leakage protection circuit generate an electrical leakage test current and the secondary coil thereof generates a sensor signal; the silicon controlled rectifier SCR is triggered to conduct and the trip coil 61 is given a short-circuit connection. The stationary armature 84 loses magnetic force such that the movable armature 85 is released, the locking bit 811 of the rod 81 is separated out from the bayonet 831 by the action of the rod reset spring 82, and the trip board 83 loses upward pull; gravity then acts to swing the free ends of the movable springs 7 downward, thus disconnecting the movable contact points 71 from the stationary contact points 51, and therefore disconnecting the power supply cable of the connecting load from the pins. The utility power supply is thereby stopped from supplying power to the household appliance, and the household appliance ceases operating.

Figure 12:
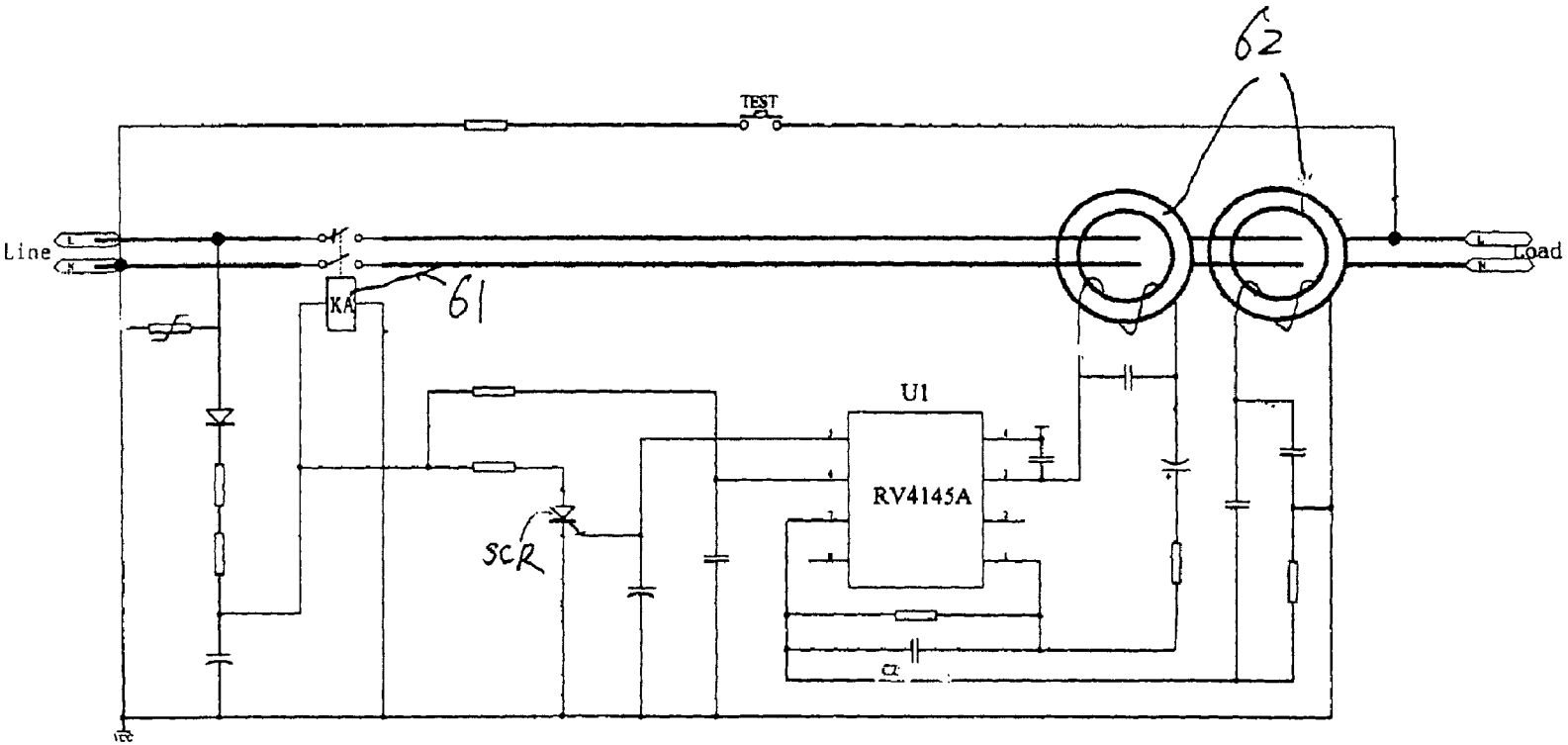
FIG. 12 is a schematic circuitry diagram of the leakage protection circuit of the present invention.

As illustrated in FIG. 12, the leakage protection circuit comprises a trip coil 61, two zero-sequence transformers 62, a control chip U1, and a silicon controlled rectifier SCR; a metal ring of the zero-sequence transformer 62 is disposed on the power supply cable of the connection load, such that a secondary coil of the zero-sequence transformer 62 is connected to the input end of the control chip U1, the output end of the control chip 63 is connected with the control gate of the silicon controlled rectifier SCR, and the cathode of the silicon controlled rectifier SCR is connected with one end of the trip coil 61. When there is an inadvertent leakage failure while the household appliance is in use, when the leakage current reaches 4~6 mA, a leakage current signal is sensed in the secondary coil of the zero-sequence transformer 62, the silicon controlled rectifier SCR is triggered to conduction, and the trip coil 61 is given a short-circuit connection; the stationary armature 84 loses magnetic force such that the movable armature 85 is released, the locking bit 811 of the rod 81 is separated out from the bayonet 831 by the action of the rod reset spring 82, and the trip board 83 loses upward pull. Gravity then acts to swing the free ends of the movable springs 7 downward, thus disconnecting the movable contact points 71 from the stationary contact points 51, and therefore disconnecting the power supply cable of the connecting load from the pins. The utility power supply is thereby stopped from supplying power to the household appliance, and the household appliance ceases operating.

Alternatively, when any one phase of the power supply live wire or neutral wire experiences circuit break, the trip coil 61 experiences a circuit break, such that the stationary armature 84 loses magnetic force and the movable armature 85 is released, the locking bit 811 of the rod 81 is separated out from the bayonet 831 by the action of the rod reset spring 82, and the trip board 83 loses upward pull. Gravity then acts to swing the free ends of the movable springs 7 downward, thus disconnecting the movable contact points 71 from the stationary contact points 51, and therefore disconnecting the power supply cable of the connecting load from the pins. The utility power supply is thereby stopped from supplying power to the household appliance, and the household appliance ceases operating.

Industrial Applicability

The present invention is a power plug, which possesses a leakage protection function and therefore can be applied to industrial use.

What is claimed is:

1. A power plug having a leakage protection function, comprising a casing, a reset button and a test button being provided to the surface of the top of the casing; a power supply live wire pin, neutral wire pin, and ground wire pin being provided to the bottom of the casing; a circuit board being provided to the interior of the casing; and a leakage protection circuit for detecting a cable leakage failure on the output of the power source being provided onto the circuit board; wherein a pair of movable springs for separate electrical connections with the power supply live wire plug and the neutral wire plug are fixedly provided to the bottom of the circuit board, movable contact points of the separate electrical connections being on the free ends of the pair of movable springs, and a pair of stationary contact points corresponding to the movable contact points being provided on the circuit board, such that the stationary contact points are connected with the power supply cable for the connection load; and wherein a tripping device capable of contacting or disconnecting the movable contact points and stationary points is provided inside the casing, the tripping device comprising a rod that is fixedly connected to the reset button, such that a rod reset spring that is disposed on the rod is fixed to a trip board on the free ends of the pair of movable springs, a stationary armature and movable armature inside a trip coil, the lower end of the rod being slidably connected to the movable armature and a locking bit being provided on the rod, and the trip board being provided with a bayonet of the locking bit, which can lock the rod in after the stationary armature has attracted the movable armature.

2. The power plug having a leakage protection function according to claim 1, wherein the casing is constituted of a front-top cover, a rear-top cover, and a lower cover for fastening the front-top cover and rear-top cover together, such that the reset button and test button are provided in holes on the top surface of the rear-top cover and exposed to the exterior, and the power supply live wire pin, neutral wire pin, and ground wire pin perforate holes in the lower surface of the lower cover and extend outwardly.

3. The power plug having a leakage protection function according to claim 1, wherein one end of the movable armature stretches out of the trip coil, that end being provided with an annular groove, such that the lower end of the rod is provided with a longitudinal slot that slidably interlocks with the annular groove.

4. The power plug having a leakage protection function according to claim 3, wherein a protective shield is fixedly provided to the bottom of the circuit board, the trip coil being fixed into the protective shield, and an opening through which the movable armature perforates being arranged on the protective shield; and a pair of fixed ears are disposed on the top of the protective shield, one end of each of the pair of movable springs being fixed to the pair of fixed ears, and a pin fixation board is fixedly provided to the bottom of the protective shield, jacks for fixing the pins being provided on the pin fixation board.

5. The power plug having a leakage protection function according to claim 1, wherein the trip board is provided with two connection blocks, fixation holes being arranged on the connection blocks, such that the free ends of the movable springs are inserted into and locked into the fixation holes and cause the trip board to be fixed to the end parts of the two movable springs, the movable contact points being provided on the connection blocks and electrically connected to the movable springs.

6. The power plug having a leakage protection function according to claim 1, wherein the bottom surface of the test button is provided with a U-shaped metal pin and test reset spring, and the bottom of the circuit board corresponding to the U-shaped metal pin is provided with two test solder joints, which together with the U-shaped metal pin constitute a simulation test switch.

7. The power plug having a leakage protection function according to claim 1, wherein the leakage protection circuit comprises a trip coil, two zero-sequence transformers, a control chip, and a silicon controlled rectifier; and a metal ring of the zero-sequence transformer is disposed on the power supply cable of the connection load, such that a secondary coil of the zero-sequence transformer is connected to the input end of the control chip, the input end of the control chip is connected with the control gate of the silicon controlled rectifier, and the cathode of the silicon controlled rectifier is connected with one end of the trip coil.

8. The power plug having a leakage protection function according to claim 2, wherein one end of the movable armature stretches out of the trip coil, that end being provided with an annular groove, such that the lower end of the rod is provided with a longitudinal slot that slidably interlocks with the annular groove.

9. The power plug having a leakage protection function according to claim 8, wherein a protective shield is fixedly provided to the bottom of the circuit board, the trip coil being fixed into the protective shield, and an opening through which the movable armature perforates being arranged on the protective shield; and a pair of fixed ears are disposed on the top of the protective shield, one end of each of the pair of movable springs being fixed to the pair of fixed ears, and a pin fixation board is fixedly provided to the bottom of the protective shield, jacks for fixing the pins being provided on the pin fixation board.

* * * * *